United States Patent [19]

Harrington

[11] 4,115,775

[45] Sep. 19, 1978

[54] DEEP PENETRATING FOREBODY WITH TETHERED RADAR REFLECTOR

[75] Inventor: John J. Harrington, Tewksbury, Mass.

[73] Assignee: The United States of America as represented by the Secretary of the Air Force, Washington, D.C.

[21] Appl. No.: 727,103

[22] Filed: Sep. 29, 1976

[51] Int. Cl.[2] ..... H01Q 15/00

[52] U.S. Cl. ..... 343/18 B

[58] Field of Search ..... 343/18 B

[56] References Cited

U.S. PATENT DOCUMENTS

| | | | |
|---|---|---|---|
| 2,763,002 | 9/1956 | Fitzgerald et al. | 343/18 B X |
| 3,220,004 | 11/1965 | Gillespie, Jr. | 343/18 B |
| 3,530,469 | 9/1970 | Dailey et al. | 343/18 B |
| 3,900,849 | 8/1975 | Scott et al. | 343/18 B X |

*Primary Examiner*—T.H. Tubbesing

*Attorney, Agent, or Firm*—Joseph E. Rusz; Arsen Tashjian

[57] ABSTRACT

An aid in penetrating hostile radar defenses by forming target images that are false in size and configuration. The inventive device includes: a cone-shaped deep penetrating forebody with an orgival nosetip; a bellows-fold, expansible, cylinder-like shaped, tethered radar signal reflector bag connected to the aft end of the forebody and carrying a plurality of circumferential crown reflectors along its length, and a cannister lined with a plurality of sabots to house, hold and support the payload (i.e., the forebody and the connected radar reflector bag) until the payload is launched and is separated from the cannister and the sabots.

10 Claims, 5 Drawing Figures

FIG. 1
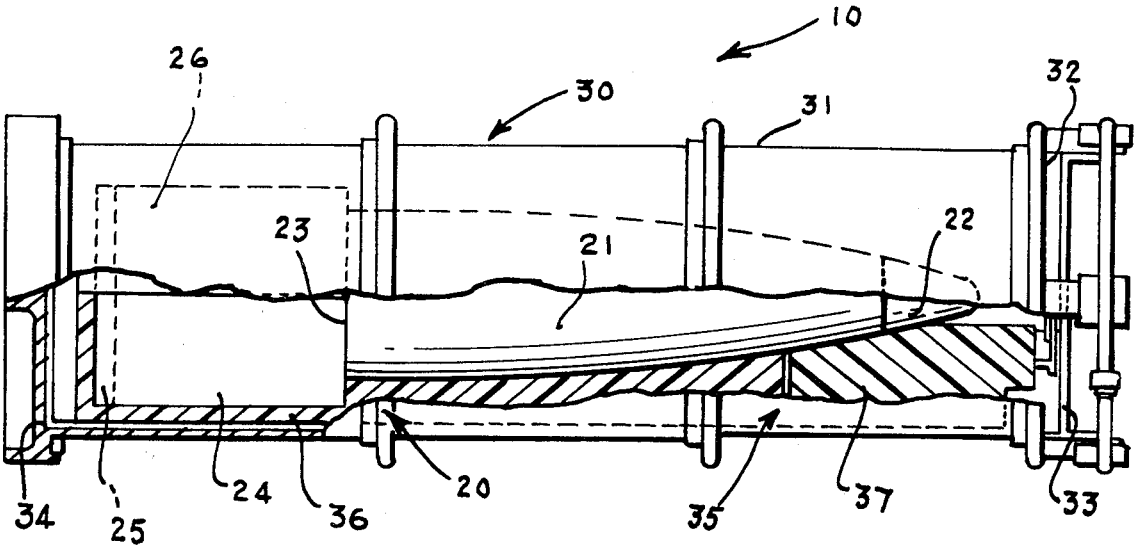
FIG. 2
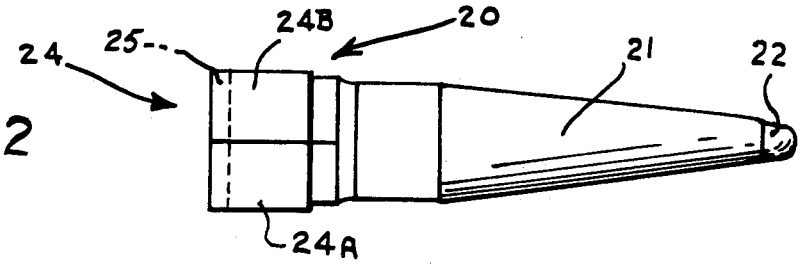
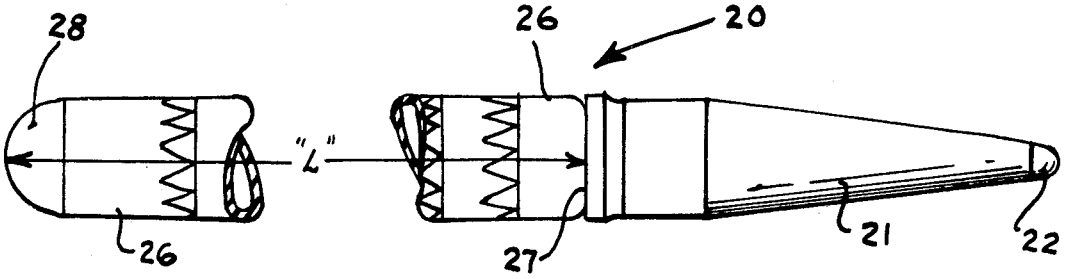
FIG. 3

FIG. 4
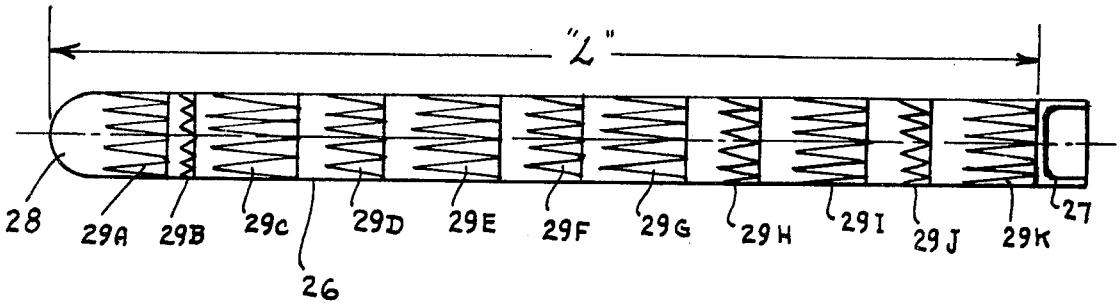
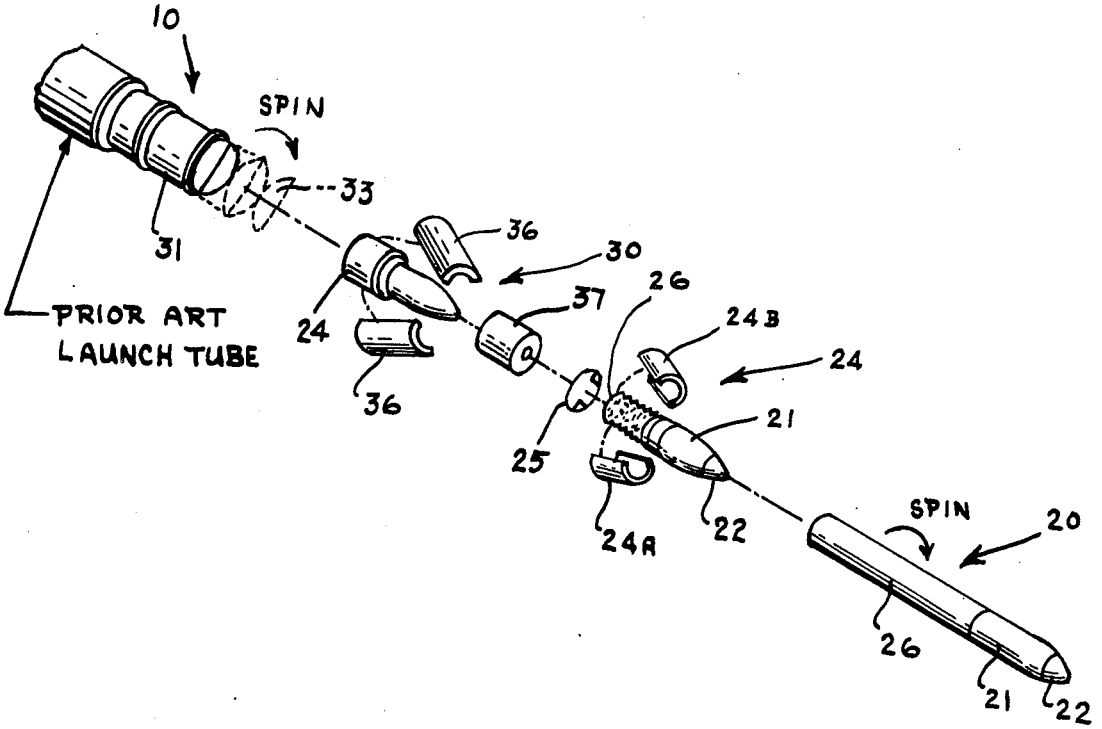
FIG. 5

DEEP PENETRATING FOREBODY WITH TETHERED RADAR REFLECTOR

STATEMENT OF GOVERNMENT INTEREST

The invention described herein may be manufactured and used by or for the Government for governmental purposes without the payment of any royalty thereon.

BACKGROUND OF THE INVENTION

This invention relates to an outer space device and, more particularly, to an electronic signal reflecting device, such as a radar reflector, capable of forming a false target for hostile radar scanners and/or radar homing missiles.

It is obviously in the interest of national security that the U.S. Government have available for self-defense an electronic signal reflecting device for use in outer space, and for re-entry therefrom, which is capable of forming a target which is false in size and/or in configuration, thereby functioning as an aid in penetrating the defenses of hostile forces by deceiving hostile radar scanners, radar homing missiles, and the like.

I have invented such a device, as adapted for use as a radar reflector; and, thereby, I have significantly advanced the state-of-the-art.

SUMMARY OF THE INVENTION

This invention pertains to a unique electronic signal reflecting device, as adapted for use as a radar signal reflector, for use in forming a reflected image of the device (or "target") which is false in size and/or in configuration.

Accordingly, the principal object of this invention is to teach the structure of a preferred embodiment of the inventive device.

Another object of this invention is to provide such a device as described hereinabove, wherein said device is useable in outer space and for safe reentry therefrom.

Still another object of this invention is to provide such a device that will permit survival of it to 150 kft under normal reentry conditions.

Yet another object of this invention is to provide such a device which can be launched from a conventional launch tube from any platform, including one that is airborne.

These objects, and other equally important and/or related objects, of this invention will become readily apparent after a consideration of the description of the invention, coupled with reference to the contents of the drawings.

DESCRIPTION OF THE DRAWINGS

FIG. 1 is a side elevation view, partially in cross section, partially fragmented, and in simplified form, of a preferred embodiment of the inventive device, packaged for launching from a prior art launch tube;

FIG. 2 is a side elevation view in simplified schematic form, of a major subassembly component of the preferred embodiment of the inventive device, in a stowed condition;

FIG. 3 is a side elevation view, in simplified schematic form and partially fragmented, the same major subassembly component, shown in FIG. 2, of the preferred embodiment of the inventive device, but in a deployed condition;

FIG. 4 is a side elevation view, in simplified schematic form and partially fragmented, of a component of the major subassembly of the preferred embodiment of the inventive device, shown in FIGS. 2 and 3; and, FIG. 5 is a simplified pictorial representation of the sequence in deploying two connected major components (i.e., the payload) of the inventive device.

DESCRIPTION OF THE PREFERRED EMBODIMENT

With reference to FIG. 1, shown therein is a preferred embodiment 10 of the invention, as adapted for use as a radar signal reflector penetration aid, packaged for launching from a prior art launch tube, such as the Model I Philco-Ford, on any platform, including one that is airborne.

As shown in this Figure of the drawing, the preferred embodiment 10 comprises essentially: a payload subassembly, generally designated 20; and, a housing subassembly, generally designated 30, that surrounds the payload subassembly 20, and is used for containing (and holding and supporting) the payload assembly 20 in a stowed condition.

The payload assembly 20 includes: a cone-shaped, deep penetrating forebody 21 having an orgival-shaped nosetip 22 forward (or "fore") and a base 23 aft; a split, hollow, open-ended container 24, having a removably attached aft cover 25 and, a bellows-folded, expansible, cylinder-like shaped, tethered radar signal reflector bag 26 (not shown) that is releasably connected to the aft base 23 of the forebody 21. It is here to be noted that the tethered radar signal reflector bag 26 referred to is bellows-folded in container 24 in its stowed condition, as distinguished from the deployed condition after launch, which will be shown and discussed later herein.

As a matter of preference, rather than of limitation, the forebody 21 is structured of aluminum, with the nosetip 22 being made of a suitable pyrolitic graphite, such as "ATJ", and with the entire forebody 21 heat-shielded with a suitable tetrafluoroethylene resin, such as "Teflon". The preferred dimensions of the forebody 21 are approximately 27 inches in length, and 6.5 inches in width (i.e., diameter) at the aft base end 23.

Still with reference to FIG. 1, the housing subassembly 30 includes: a hollow cannister 31 having an open fore end 32 with a removably attached cover 33 closing the open fore end 32, and also having an aft end 34, with the fore end selectively openable and, of course, closeable; and, means (generally designated 35) for holding and supporting the payload subassembly 20 within the hollow cannister 31, with this means 35 further, including a split sabot 36 essentially at the aft end 34 of the hollow cannister 31, and a one piece sabot 37 at the fore end 32 of the hollow cannister. More specifically, the split sabot 36 completely encases the radar reflector bag container 24 and cover 25, and a rearward portion of the forebody 21.

Also as a matter of preference, and not of limitation, the hollow cannister 31 is made of aluminum, with preferred dimensions of 39.6 inches in length and 12 inches in width (i.e., diameter). The removable cannister cover 33 is preferably in two portions, with each portion consisting of a complementary semi-circle. The split sabot 36 lining essentially the aft end of the cannister 31 is preferably of polystyrene foam, and the one piece sabot 37 lining the fore end of the cannister 31 is preferably of "Eccofoam".

Now, with reference to FIGS. 2 and 3, said Figures are self-explanatory in the sense that in FIG. 2 the payload subassembly component 20 of the inventive device 10, FIG. 1, is shown in a stowed condition, out of the cannister 31, FIG. 1, and also in the sense that in FIG. 3 the payload subassembly component 20 of the inventive device 10, FIG. 1, is shown in a deployed condition out of the cannister 31, FIG. 1. However, from FIG. 2, the reader easily can see the split portions 24A and 24B of the bellows-folded, tethered radar signal reflector bag container 24. That contaaner 24 is made preferably of fiberglass. Further, from FIG. 3 it is to be noted that the expansible, cylinder-like shaped, tethered radar signal reflector bag 26, which is releasably connected to the aft base of the forebody 21, has: an open forward end 27; a closed aft end 28, preferably in the shape of a hemisphere; and, is preferably inflatable, made of rubber, and reinforced with fiberglass cloth. It is also to be noted from FIG. 3 that the cylinder-like shaped radar signal reflector bag 26 has a length "L", along which are affixed a plurality of circumferential crown reflectors, such as representative ones 29A, 29J and 29K.

With reference to FIG. 4, therein is shown the cylinder-like shaped, tethered radar signal reflector bag component 26 of the payload subassembly 20, FIGS. 1–3, inclusive, in a deployed condition. The reflector bag 26 has, a previously indicated, a plurality of circumferential crown reflectors, such as 29A–29K, inclusive, affixed to the radar reflector 24 along its length "L". The crown reflectors are in spaced relationship to each other; and, preferably, the plurality thereof consists of eleven (11) individual crown reflectors, each of which is preferably made of flat-braid copper wire (25 strands × 0.003 inch diameter), and each of which has preferably 12 points to each crown. The preferred dimensions of the tethered reflector bag 26 are approximately 101 inches in length and 6 inches in width (i.e., diameter).

Now, with reference to FIG. 5, therein is shown in simplified form, the sequence in deploying the payload 20 of the inventive device 30. The sequence in that deployment is as indicated in the Figure from the reader's left to the reader's right and is self-explanatory, except that the opening of the cannister doors 33, and the separation of the sabots 36 and 37 and of the radar signal reflector bag container 24, may be spring-assisted.

MANNER OF OPERATION OF THE PREFERRED EMBODIMENT

The manner of operation of the preferred embodiment 10, FIG. 1, of my inventive device can be very easily ascertained by a person of ordinary skill in the art from the foregoing description, together with reference to the Figures of the drawings, particularly FIG. 4 thereof.

For others, it is sufficient to say in explanation that, after the preferred embodiment is "launched" (fore end first) from a prior art launch tube (which, it is to be noted, imparts a rotation or spin during "launching" or "ejection", but actually retains the cannister 31) the cannister cover 33 portions at the fore end 32 open, allowing the payload subassembly 20 and the sabots 36 and 37 to slide out of the cannister 31 and be thrust forward and away. Then, the one piece fore sabot 37 separates from the nosetip 22 of the forebody 21 and the split, two-piece aft sabot 36 separates from the radar signal reflector container 24 and the aft portion of the forebody which it supports and holds. Next, the constituent split portions 24A and 24B of the reflector bag container 24, and the aft cover 25 removably attached to the container 24, separate, exposing and releasing the bellows-folded radar signal reflector bag 26 which then extends, primarily due to residual air within the reflector bag 26, assuming a vacuum or vacuum-like environment.

The payload deployment sequence is, thereby, completed; and, the payload (i.e., the forebody 21, and the extended radar signal reflector bag 26 connected to the aft base 23 surface of the forebody 21) is completely passive, operational, and effective as a hostile radar penetration aid, and will survive to 150,000 feet under nominal reentry conditions.

CONCLUSION

It is abundantly clear from all of the foregoing, and from the contents of the Figures of the drawings, that the stated desired objects, and the equally important and related objects, of my invention have been attained.

It is to be noted that, although there have been described the fundamental and unique features of my invention, as applied to a particular embodiment adapted for a particular purpose, various other embodiments, adaptations, substitutions, additions, omissions, and the like, may occur to, and can be made by, those of ordinary skill in the art, without departing from the spirit of my invention. For example, suitable conventional means well known in the art may be used to further extend (and to internally pressurize and inflate and further expand and/or distend) the radar signal reflector bag 26 (e.g., "Freon" liquid may be released from pressure tanks internal of the bag 26 with and by the use of squibs).

What is claimed is:

1. An electronic signal reflector, adapted for use as a radar signal reflector, capable of forming a target which is false in size and in configuration, comprising:

a. a payload subassembly which includes:

(1) a cone-shaped, deep penetrating forebody having an orgival nosetip fore and a base aft;

(2) a bellows-folded, expansible, cylinder-like shaped, tethered radar signal reflector bag, with said reflector bag releasably connected to said aft base of said deep penetrating forebody, and with said reflector bag having an open foreward end, a closed aft end, and a length along which are affixed a plurality of circumferential crown reflectors in spaced relationship to each other;

(3) and, a split, hollow, open-ended container, having a removably attached aft cover, for housing said bellows-folded, tethered radar signal reflector bag.

b. a housing subassembly surrounding said payload subassembly, for containing said payload subassembly, which includes:

(1) a hollow cannister having an open fore end with a removably attached cover closing said fore end, and an aft end whereby said fore end is selectively openable;

(2) and, means for holding and supporting said payload subassembly within said hollow cannister, wherein said means further includes:

(a) a split sabot essentially at said aft end of said hollow cannister;

(b) and, a one piece sabot at said fore end of said hollow cannister.

2. An electronic signal reflector, as set forth in claim 1, wherein said cone-shaped, deep penetrating forebody is structured of aluminum, said nosetip of said forebody is made of ATJ pyrolitic graphite, and said forebody is completely heatshield with a tetrafluoroethylene resin.

3. An electronic signal reflector, as set forth in claim 1, wherein said cylinder-like shaped, tethered radar signal reflector has a hemispherical aft end.

4. An electronic signal reflector, as set forth in claim 1, wherein said cylinder-like shaped, tethered radar signal reflector is inflatable.

5. An electronic signal reflector, as set forth in claim 4, wherein said inflatable, cylinder-like shaped, tethered radar signal reflector is made of rubber.

6. An electronic signal reflector, as set forth in claim 4, wherein said rubber, inflatable, cylinder-like shaped, tethered radar signal reflector is reinforced with fiberglass cloth.

7. An electronic signal reflector, as set forth in claim 1, wherein said crown reflectors affixed to said cylinder-like shaped, tethered radar signal reflector are made of flat-braided copper wire.

8. An electronic signal reflector, as set forth in claim 1, wherein said plurality of crown reflectors affixed to said cylinder-like shaped, tethered radar signal reflector are eleven in number.

9. An electronic signal reflector, as set forth in claim 1, wherein said hollow cannister of said housing subassembly is made of aluminum.

10. An electronic signal reflector, as set forth in claim 1, wherein said split sabot is made of polystyrene foam, and said one piece sabot is made of "Eccofoam".

* * * * *